US008538249B2

(12) United States Patent
Shaffer et al.

(10) Patent No.: US 8,538,249 B2
(45) Date of Patent: Sep. 17, 2013

(54) BROILER FOR COOKING APPLIANCES

(75) Inventors: Timothy Scott Shaffer, LaGrange, KY (US); Blake Philip Bomar, Louisville, KY (US)

(73) Assignee: General Electric Company, Schenectady, NY (US)

( * ) Notice: Subject to any disclaimer, the term of this patent is extended or adjusted under 35 U.S.C. 154(b) by 848 days.

(21) Appl. No.: 12/582,346

(22) Filed: Oct. 20, 2009

(65) Prior Publication Data

US 2011/0091189 A1 Apr. 21, 2011

(51) Int. Cl.
*F21V 7/00* (2006.01)

(52) U.S. Cl.
USPC ..... 392/422; 392/407; 392/416; 392/424

(58) Field of Classification Search
None
See application file for complete search history.

(56) References Cited

U.S. PATENT DOCUMENTS

| | | | | | |
|---|---|---|---|---|---|
| 2,456,988 | A | * | 12/1948 | Pierson | 99/446 |
| 2,836,697 | A | * | 5/1958 | Jordan | 219/396 |
| 2,864,025 | A | * | 12/1958 | Foote et al. | 313/279 |
| 3,003,409 | A | | 10/1961 | Mills | |
| 3,005,082 | A | * | 10/1961 | Ammerman | 219/537 |
| 3,036,194 | A | * | 5/1962 | Deininger | 219/532 |
| 3,270,660 | A | * | 9/1966 | Filipak | 99/340 |
| 3,538,374 | A | * | 11/1970 | Kane | 313/273 |
| 3,714,885 | A | * | 2/1973 | Wertheimer et al. | 99/425 |
| 3,770,939 | A | * | 11/1973 | Kokjohn | 219/532 |
| 4,020,323 | A | * | 4/1977 | Dills | 219/405 |
| 4,126,757 | A | | 11/1978 | Smith, Jr. et al. | |
| 4,249,032 | A | | 2/1981 | Smith, Jr. et al. | |
| 4,377,618 | A | | 3/1983 | Ikeda et al. | |
| 4,430,557 | A | | 2/1984 | Eichelberger et al. | |
| 4,477,706 | A | | 10/1984 | Mittelsteadt | |
| 4,556,786 | A | * | 12/1985 | Frost et al. | 219/459.1 |
| 4,577,092 | A | * | 3/1986 | Lenoir | 392/418 |
| 4,598,194 | A | * | 7/1986 | Halberstadt et al. | 219/459.1 |
| 4,629,865 | A | * | 12/1986 | Freedman et al. | 219/405 |
| 5,338,911 | A | | 8/1994 | Brandberg et al. | |
| 5,964,211 | A | * | 10/1999 | Sargunam et al. | 126/19 R |
| 6,012,444 | A | | 1/2000 | Skender | |

(Continued)

FOREIGN PATENT DOCUMENTS

| | | |
|---|---|---|
| JP | 2004127819 | 4/2004 |
| JP | 2007029180 | 2/2007 |

(Continued)

OTHER PUBLICATIONS

Carbon Fiber Heating Lamp (use for room heater and Microwave Oven); last accessed at http://www.himfr.com/d-p116271073521809100-carbon_fiber_heating_lamp_(use_for_room_heater_and_Microwave_Oven_)/.

(Continued)

*Primary Examiner* — Thor Campbell
(74) *Attorney, Agent, or Firm* — Global Patent Operation; Douglas D. Zhang

(57) ABSTRACT

A broiler assembly for a cooking appliance, the cooking appliance having an oven cavity and the broiler assembly is disposed within the oven cavity. The broiler assembly includes a reflector having first and second sides, side retainers coupled to a respective one of the first and second sides, and at least one carbon emitter heating element mounted to the side retainers. The at least one carbon emitter heating element includes a carbon filament disposed within a lamp.

15 Claims, 6 Drawing Sheets

(56) References Cited

U.S. PATENT DOCUMENTS

| | | | | |
|---|---|---|---|---|
| 6,018,146 | A | 1/2000 | Uzqiris et al. | |
| 6,057,532 | A * | 5/2000 | Dexter et al. | 219/553 |
| 6,069,345 | A * | 5/2000 | Westerberg | 219/411 |
| 6,222,163 | B1 * | 4/2001 | Arntz et al. | 219/483 |
| 6,297,481 | B1 | 10/2001 | Gordon | |
| 6,348,676 | B2 | 2/2002 | Kim et al. | |
| 6,407,371 | B1 | 6/2002 | Toya et al. | |
| 6,433,318 | B2 * | 8/2002 | Danko | 219/536 |
| 6,448,570 | B1 * | 9/2002 | Scherzer et al. | 250/495.1 |
| 6,501,056 | B1 * | 12/2002 | Hirohata et al. | 219/553 |
| 6,591,062 | B2 * | 7/2003 | Scherzer et al. | 392/407 |
| 6,624,398 | B2 * | 9/2003 | Sherrill et al. | 219/536 |
| 6,922,017 | B2 | 7/2005 | Konishi et al. | |
| 6,931,985 | B1 | 8/2005 | Attie | |
| 6,949,727 | B2 * | 9/2005 | Park | 219/548 |
| 7,323,663 | B2 | 1/2008 | Cavada et al. | |
| 7,488,919 | B2 | 2/2009 | Gaqas et al. | |
| 2006/0032847 | A1 | 2/2006 | Kim et al. | |
| 2007/0054566 | A1 * | 3/2007 | Gracki et al. | 439/851 |

FOREIGN PATENT DOCUMENTS

| | | |
|---|---|---|
| JP | 2007054118 | 3/2007 |
| WO | 2005051043 | 6/2005 |
| WO | 2009022847 | 2/2009 |

OTHER PUBLICATIONS

Heraeus Noblelight, Inc.—Carbon High Powered Infrared Heater; last accessed at: http://www.globalspec.com/FeaturedProducts/Detail/HeraeusNoblelight/Carbon_High_Powered_Infrared_Heater/8715/0.

Carbon High Power Radiant Heater from Heraeus Noblelight, Inc.; last accessed at http://www.globalspec.com/FeaturedProducts/Detail/HeraeusNoblelight/Radiant_Heater_Carbon_High_Power/10955/0.

Browning Convenience Meals—Infrared Heating of Oven-Ready Meals; Heraeus Noblelight Inc., Feb. 23, 2009; last accessed at http://news.thomasnet.com/companystory/556586.

Carbon Emitters utilize Infrared Heating Technology; May 25, 2005; ThomasNet News; last accessed at http://news.thomasnet.com/fullstory/463755.

* cited by examiner

BROILER FOR COOKING APPLIANCES

BACKGROUND OF THE INVENTION

The present disclosure relates generally to cooking appliances and more particularly to broilers for cooking appliances.

Generally, heating elements in, for example, an oven cavity of a cooking appliance should efficiently and evenly direct heat towards food items being cooked. However, conventional heating elements such as, for example, sheath heaters, halogen lamps, and quartz lamps, transmit heat in all directions with much of the heat being absorbed by the oven cavity walls. This generally results in heat not being delivered efficiently and directly to the food, as well as extreme heat gradients where food is unevenly cooked across its exposed surface. Radiant ribbon heaters transmit heat more directional and can be more efficient in delivering heat directly to food, but they are generally sluggish since they require a backside insulative mat to support and position the ribbons and have a fair amount of heater mass to overcome. It is also the nature of the ribbons to be aligned width-wise in parallel with intended radiation path to the food rather than the more efficient perpendicular orientation.

Recently, there have been several advances in a variety of infrared quartz tubular heaters called carbon emitters that are produced by companies such as Panasonic and Heraeus Noblelight. These heaters, while encased and sealed in an inert gaseous environment, use a wide, yet flat carbon filament that heats up quickly and intensely when current is applied. The carbon filaments, which are generally made of carbon fibers and carbon dominated matrices, are very low in mass, and can heat up in less than 3 seconds and exhibit no adverse in-rush characteristics that tend to plague some of the more traditional heaters that principally use metallic filaments such as tungsten. For example, a standard quartz heater that uses a tungsten filament may have an in-rush current spike of 10 A compared to its eventually steady state current of 1 A.

Carbon emitters, while having no substantial in-rush surges, are also very directional in their ability to apply heat since the filaments are very thin and very wide. They are extremely efficient when the filaments within the tubes are placed in a perpendicular direction relative to the radiation path to the object being heated. There are industrial applications of carbon emitters. For example, carbon emitters have been used to dry coatings. However, they have not been used in either the commercial or residential appliance industry. With the need to limit demand peaks at the utilities and the difficulties to build new power plants in the US, the carbon emitter technology provides an opportunity to reduce the wattage required to adequate cook or broil food by more efficiently directing heat from the broiler above the food down onto the food.

It would be advantageous to be able direct heat efficiently and more evenly to the food being cooked within an oven cavity.

BRIEF DESCRIPTION OF THE INVENTION

As described herein, the exemplary embodiments overcome one or more of the above or other disadvantages known in the art.

One aspect of the exemplary embodiments relates to a broiler assembly for a cooking appliance. The cooking appliance has an oven cavity and the broiler assembly is disposed within the oven cavity. The broiler assembly includes a reflector having first and second sides, side retainers coupled to a respective one of the first and second sides, and at least one carbon emitter heating element mounted to the side retainers.

Another aspect of the exemplary embodiments relates to a cooking appliance. The cooking appliance includes a frame forming an oven cavity and a broiler assembly. The broiler assembly is disposed within the oven cavity. The broiler assembly includes a reflector having first and second sides, side retainers coupled to a respective one of the first and second sides, and at least one carbon emitter heating element mounted to the side retainers.

Still another aspect of the disclosed embodiments relates to a carbon emitter heating element for a broiler assembly. The broiler assembly includes a reflector having first and second sides, a first side retainer disposed on the first side of the reflector and a second side retainer disposed on the second side of the reflector. The first and second side retainers include apertures to allow mounting of the carbon emitter heating element laterally between the first and second sides. The carbon emitter heating element is a lamp having a first and second end, at least one carbon filament disposed within the lamp, a first insulator coupled to the first end of the lamp, and a second insulator coupled to the second end of the lamp. The first insulator is configured to engage an aperture of the first side retainer such that the first insulator is substantially laterally fixed within the aperture of the first side retainer. The second insulator is configured to engage an aperture of the second side retainer such that the second insulator is laterally movable within the aperture of the second side retainer.

These as other aspects and advantages of the exemplary embodiments will become more apparent from the following detailed description considered in conjunction with the accompanying drawings. It is to be understood, however, that the drawings are designed solely for the purposes of illustration and not as a definition of the limits of the invention, for which reference should be made to the appended claims. Moreover, the drawings are not necessarily to scale and, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1A:
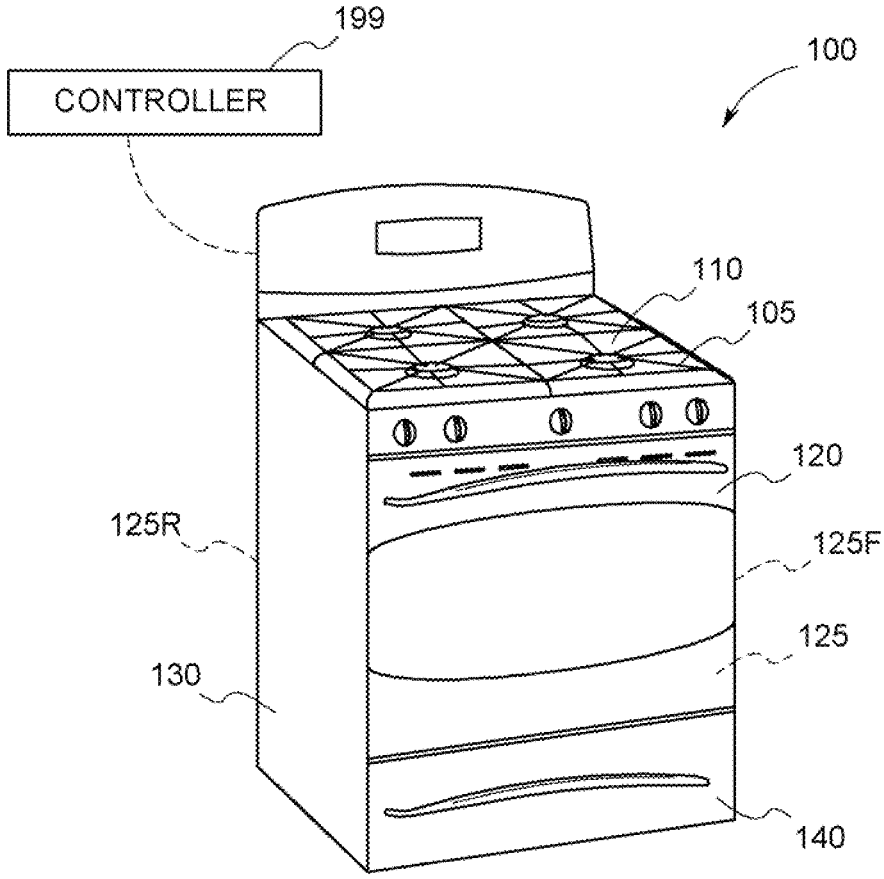
FIGS. 1A and 1B are schematic illustrations of an exemplary appliance incorporating features in accordance with the disclosed embodiments.

In one exemplary embodiment, referring to FIG. 1A, a cooking appliance 100 is provided. Although the embodiments disclosed will be described with reference to the drawings, it should be understood that the embodiments disclosed can be embodied in many alternate forms. In addition, any suitable size, shape or type of elements or materials could be used. In the examples described herein, the cooking appliance 100 is configured as a free-standing range. However, it should be understood that the aspects of the exemplary embodiments may be applied to any suitable cooking appliance having any suitable oven cavity in a manner substantially similar to that described herein.

In one aspect, the disclosed embodiments are directed to a cooking appliance 100 having a cooktop 110, an oven 120 and a warming drawer/mini-oven 140. In this example, the cooking appliance 100 is in the form of an electric operated free standing range. In alternate embodiments, the cooking appliance 100 may be any suitable cooking appliance, including but not limited to combination induction/electric and gas/electric cooking appliances having, for example, the electric heating elements described herein. The cooking appliance also includes any suitable controller 199 configured to control the appliance 100 as described herein.

Figure 1B:
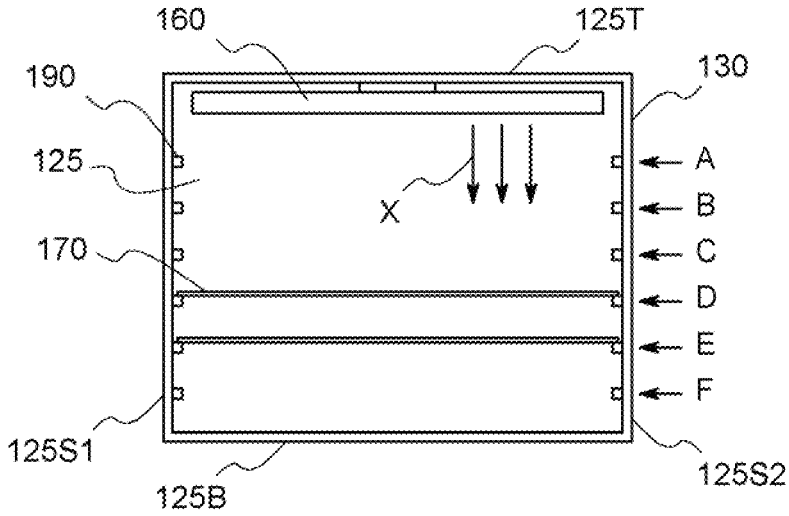

The cooking appliance 100 includes a frame or housing 130. The frame 130 forms a support for the cooktop 110 as well as internal cavities such as the oven cavity 125 of the oven 120 and/or the cavity for the warming drawer/mini-oven 140. The cooktop 110 includes one or more cooking grates 105 for supporting cooking utensils on the cooktop 110. Referring also to FIG. 1B, the oven cavity 125 is defined by a top side 125T, a bottom side 125B, a front side 125F, a rear side 125R, and lateral sides 125S1, 125S2. The oven cavity 125 may have any suitable dimensions and includes one or more rack supports 190 and a broiler assembly 160. The rack supports 190 may be located at spaced apart positions A-F of the oven cavity 125. In this example, position A is closest to the broiler assembly 160 (e.g. the top side 125T of the oven cavity 125) and position F is the closest to the bottom side 125B of the oven cavity 125. One or more oven racks 170 may be placed in a respective one of the positions A-F on the rack supports 190 so that food items may be placed on the oven rack(s) 170 for cooking.

Figure 2A:
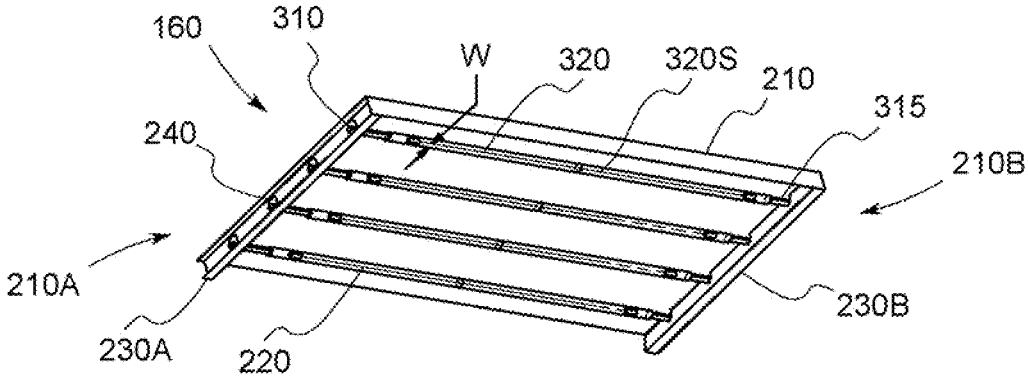
FIGS. 2A and 2B are schematic illustrations of a portion of the appliance of FIG. 1 in accordance with an exemplary embodiment.
Figure 2B:
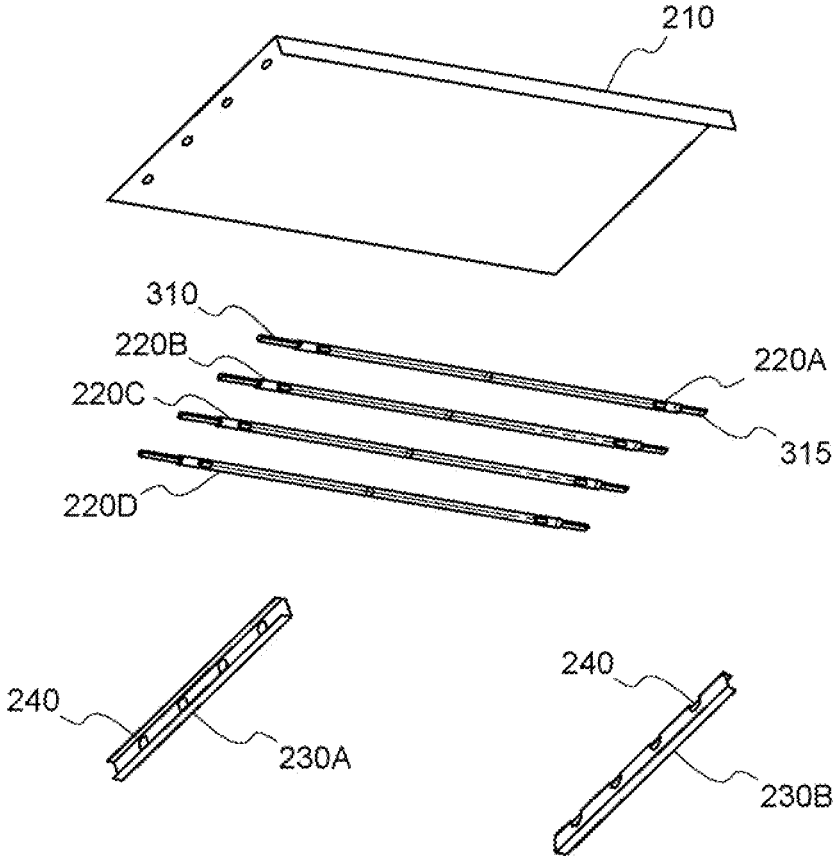

Referring to FIGS. 2A and 2B, a broiler assembly 160 is shown in accordance with an exemplary embodiment. It should be understood that while the broiler assembly 160 is shown located at the top side 125T (FIG. 1B) of the oven cavity 125 (FIG. 1B), the aspects of the exemplary embodiments can be equally applied to heating elements located at, for example, the bottom or sides of the oven cavity. In this example, the broiler assembly 160 includes a reflector 210, one or more heating elements 220A-220D and side retainers 230A, 230B. The heating elements 220A-220D are arranged so that the heating elements 220A-220D extend laterally (e.g. between lateral sides 125S1, 125S2) within the oven cavity 125 (FIG. 1B). While the heating elements 220A-220D are arranged substantially parallel with each other, in other examples, the heating elements 220A-220D may be configured in any suitable arrangement for providing a substantially uniform or even heat distribution within the oven cavity 125 (FIG. 1B), such as for example, with respect to a plane defined by an oven rack 170 located at one of oven cavity cooking positions A-F.

The reflector 210 may be constructed of any suitable heat reflective material including, but not limited to, aluminized steel. The reflector 210 may be configured to allow attachment of the broiler assembly 160 to, for example, the top 125T of the oven cavity 125 (FIG. 1B). In alternate embodiments the reflector may be configured for attachment to one or more of the lateral sides 125S1, 125S2 and the rear side 125R of the oven cavity 125 (FIG. 1B). The reflector 210 includes first and second ends 210A, 210B.

The side retainers 230A, 230B are coupled to a respective one of the first and second ends 210A, 210B in any suitable manner. For example, the side retainers may be coupled to the respective first and second ends 210A, 210B of the reflector 210 with mechanical fasteners, chemical fasteners, welds, etc. In other examples the side retainers may be integrally formed (e.g. unitary one-piece construction) with the reflector 210. The side retainers 230A, 230B may be constructed of any suitable material including but not limited to aluminized steel (or any other heat reflective material). Each of the side retainers 230A, 230B include one or more apertures 240 configured to interface with the one or more heating elements 220A-220D.

Figure 3A:
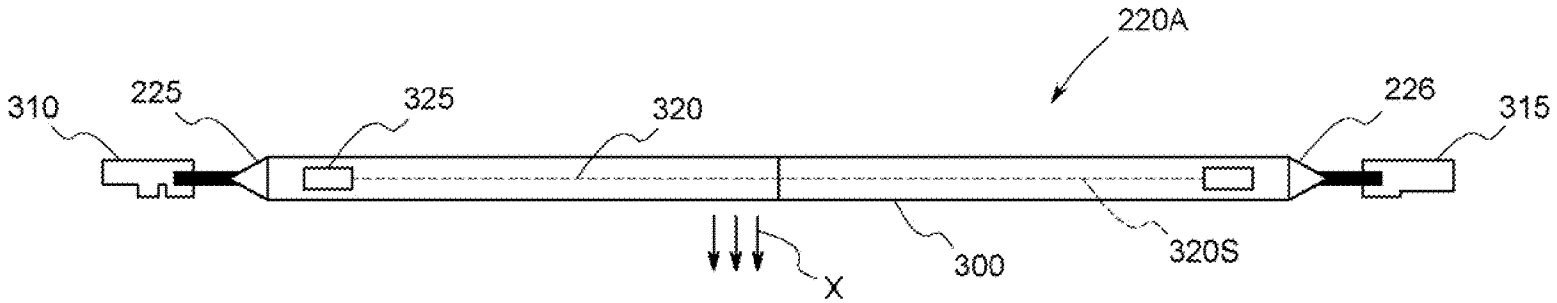
FIGS. 3A-3C are schematic illustrations of portions of a heating element in accordance with an exemplary embodiment.
Figure 3C:
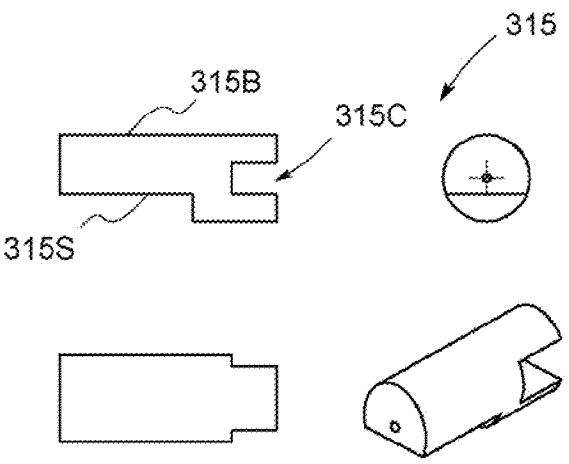
Figure 3B:
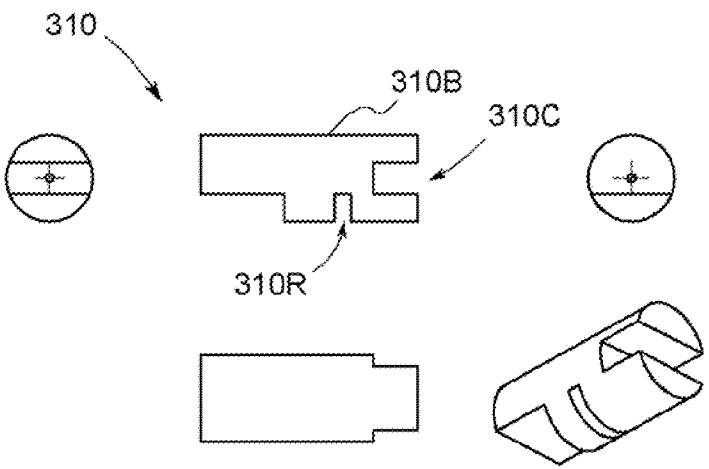

Referring also to FIGS. 3A and 3B, the one or more heating elements 220A-220D are carbon emitter infrared heaters or heating elements. The carbon emitter heating elements 220A-220D of the disclosed embodiments have a carbon filament design that combines the versatile medium-wave spectral emission with very short reaction times of just seconds. In one embodiment, the carbon emitter heating elements 220A-220D are made with fused silica or quartz tubes 325. The tubes 325 are filled with an inert gas, such as for example, argon. A carbon filament 320, generally in the form of substantially flat or thin carbon sheets, is disposed within the tube 325. In one embodiment, a substantially flat, wide carbon filament 320 is disposed within a quartz or fused silica transparent lamp 325 (e.g. a carbon emitter lamp).

The carbon filament 320 includes an insulator 310, 315 on each end that allows the heating element 220A to be easily placed in the oven in the proper orientation. In the embodiments, described herein, the proper orientation is generally with the flat carbon filament 320 facing the bottom of the oven. In alternate embodiment, the orientation of the heating elements 220A-220D is any suitable orientation that directs the heat evenly and efficiently to the food being cooked. The carbon filament 320 of the disclosed embodiments provides the highly directional characteristic to the way the heating element 220A delivers heat flux.

It should be understood that while multiple individual heating elements 220A-220D are shown and described herein, in other examples the one or more heating elements 220A-220D may include a substantially flat lamp assembly configured to house multiple carbon filaments 320 to form a multi-filament lamp. Each of the multiple carbon filaments 320 in the multi-filament lamp may be operable in substantially the same manner as the individual heating elements 220A-220D as described herein.

The carbon filament 320 may have a surface 320S that is substantially flat and has a suitable width W. The carbon filament 320 is configured to radiate substantially all of its energy in a direction X (see also FIG. 1B). The direction X is substantially perpendicular to the surface 320S. In this fashion, substantially all of the energy from the carbon filament 320 is transmitted directly to food items placed beneath the broiler assembly 160 on the oven racks 170. In one example, the width W of the of the carbon filament may be up to approximately 0.5 inches and the surface 320S may be configured to achieve an operating temperature of about 2,800° C. In other examples, the width W may be more or less than about 0.5 inches and the surface 320S may be configured to achieve an operating temperature of more or less than about 2,800° C. In one embodiment, the length of the tubes 325 is approximately 19" with a diameter of approximately 0.5". Each of the heating elements 220A-220D has a heating output of approximately 700 W. In one example, the heating elements 220A-220D are products of Panasonic Corp. The carbon filaments, which are approximately 16-inches in length, can be made various ways. They are generally carbon fibers with an inorganic binder used to give them some structural capabilities. A metallic conductive spring clip (not shown) is used to electrically and structurally connect each end of the carbon filament to current going in and out of each heating element. This clip acts not only as a conductive path, but also isolates substantially from thermal expansion during heating and large structural loads during shipping and handling. In one embodiment, the one or more heating elements 220A-220D of the broiler assembly 160 are generally configured to achieve the operating temperature within about 3 seconds of activating the broiling elements. In alternate embodiments the operating temperature may be reached in a time period faster or slower than about 3 seconds.

Each of the one or more heating elements 220A-220D includes thermal insulators 310, 315 disposed on respective ends 225, 226 of the one or more heating elements 220. In one example, the insulators 310, 315 may be constructed of any suitable insulating material such as ceramic. A first insulator 310 may be disposed on end 225 of a respective heating element, such as heating element 220A. It should be understood that the other heating elements 220B-D are configured similarly to heating element 220A. The first insulator 310 includes an insulator body 310B. In this example, the insulator body 310B is substantially cylindrical in shape but in alternate embodiments, the insulator body 310B may have any suitable shape and/or cross-section. The insulator body 310B includes an interface slot 310C configured to receive at least a portion of the heating element 220A for coupling the insulator 310 with the heating element 220A. In other examples, the insulator body 310B may have any suitable recess or other opening for receiving at least a portion of a heating element 220A for coupling the insulator 310 with the heating element 220A. The insulator body 310B also includes a retaining slot 310R that is configured to engage an edge of a respective aperture 240 in one of the side retainers 230A, 203B for stationarily locating the heating element 220A within the broiler assembly 160.

The second insulator 315 may be disposed at the opposite end 226 of the heating element 220A. The second insulator 315 includes an insulator body 315B. In this example, the insulator body 315B is substantially cylindrical in shape but in other examples the insulator body 315E may have any suitable shape and cross-section. The insulator body 315B includes an interface slot 315C that is substantially similar to the interface slot 310C described above for coupling the insulator 315 to the heating element 220A. In other examples, the insulator body 315B may have any suitable recess or other opening for receiving at least a portion of a heating element 220A for coupling the insulator 310 with the heating element 220A. The insulator body 315B also includes a retaining surface 315S. The retaining surface 315S is configured to engage an edge of a corresponding aperture 240 in another one of the side retainers 230A, 203B for supporting the heating element 220A in the broiler assembly 160. The retaining surface 315S is a substantially flat surface that allows the heating element 220A and insulator 315 to float or move around within the corresponding aperture 240 of the other side retainer 230A, 230B. In other examples, the insulators 310, 315 may have any suitable shapes and configurations for locking a respective one of the one or more heating elements 220A-220D to one of the side retainers 230A, 230B while allowing the one of the one or more heating elements 220A-220D to move within another one of the side retainers 230A, 230B.

Figure 4A:
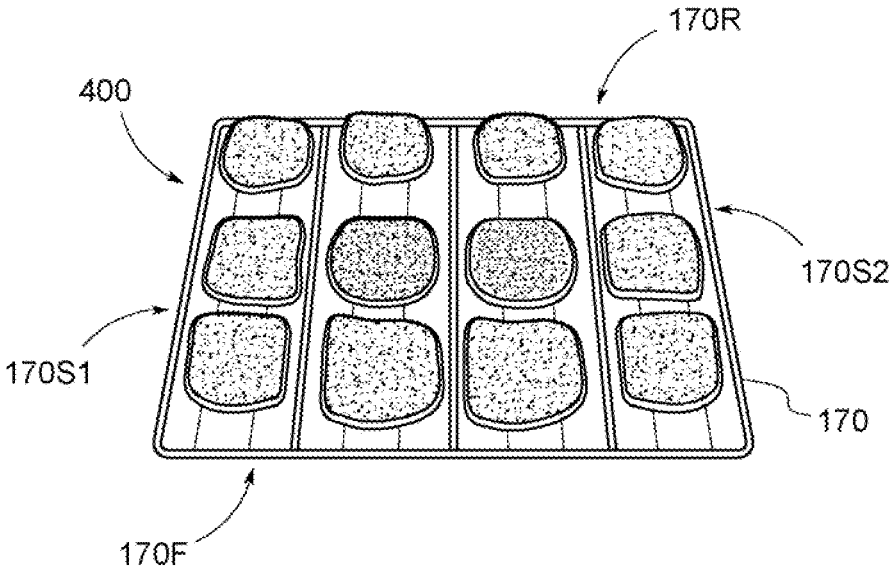
FIGS. 4A and 4B are exemplary illustrations of broil patterns using an appliance incorporating aspects of the disclosed embodiments.
Figure 4B:
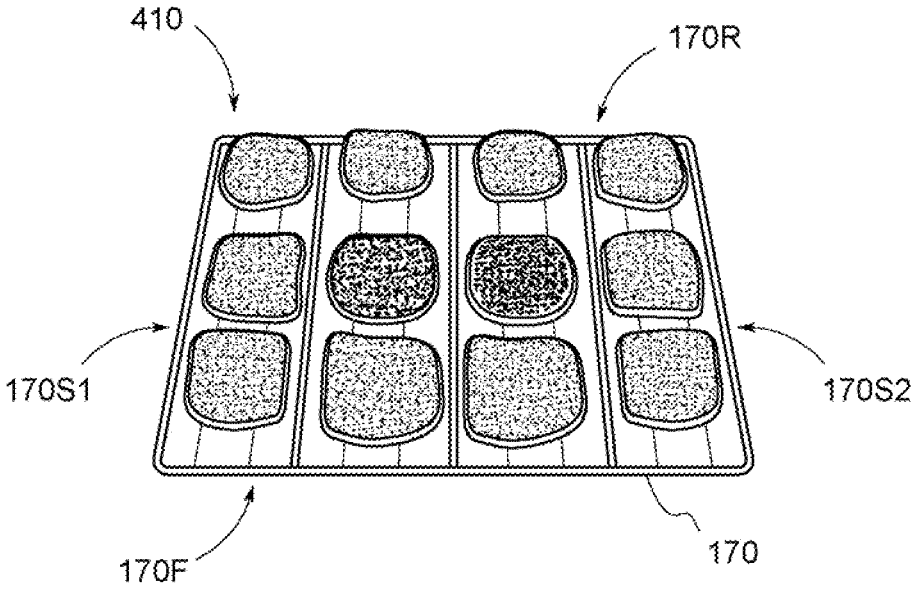

Referring again to FIG. 2A and also to FIGS. 4A and 4B, compared with conventional heaters, the broiler assembly 160 described herein provides a relatively uniform heat distribution within the oven cavity 125 (FIG. 1B). As can be seen in FIG. 4A, a toast pattern 400 is illustrated with respect to slices of bread placed on an oven rack 170 located at, for example, oven cavity cooking position D. As can be seen in FIG. 4A, the toast pattern 400 is relatively even from front 170F to back 170R as well as side to side 170S1, 170S2 (corresponding to the front 125F, back 125R and lateral sides 125S1, 12S2 of the oven cavity, FIGS. 1A and 1B) along the oven rack 170. FIG. 4B illustrates another toast pattern 410 illustrated with respect to slices of bread placed on the oven rack 170 located at oven cavity cooking position C. As can be seen in FIG. 4B, the toast pattern 410 is relatively even from front 170F to back 170R and side to side 170S1, 170S2 along the oven rack 170. Compared with conventional heaters such as sheath heaters, halogen lamps, etc, the broiler assembly 160 of the present disclosure reduces the energy usage by about ⅔ while still being able to provide a comparable heating or browning performance and a relatively even heat distribution.

Figure 5A:
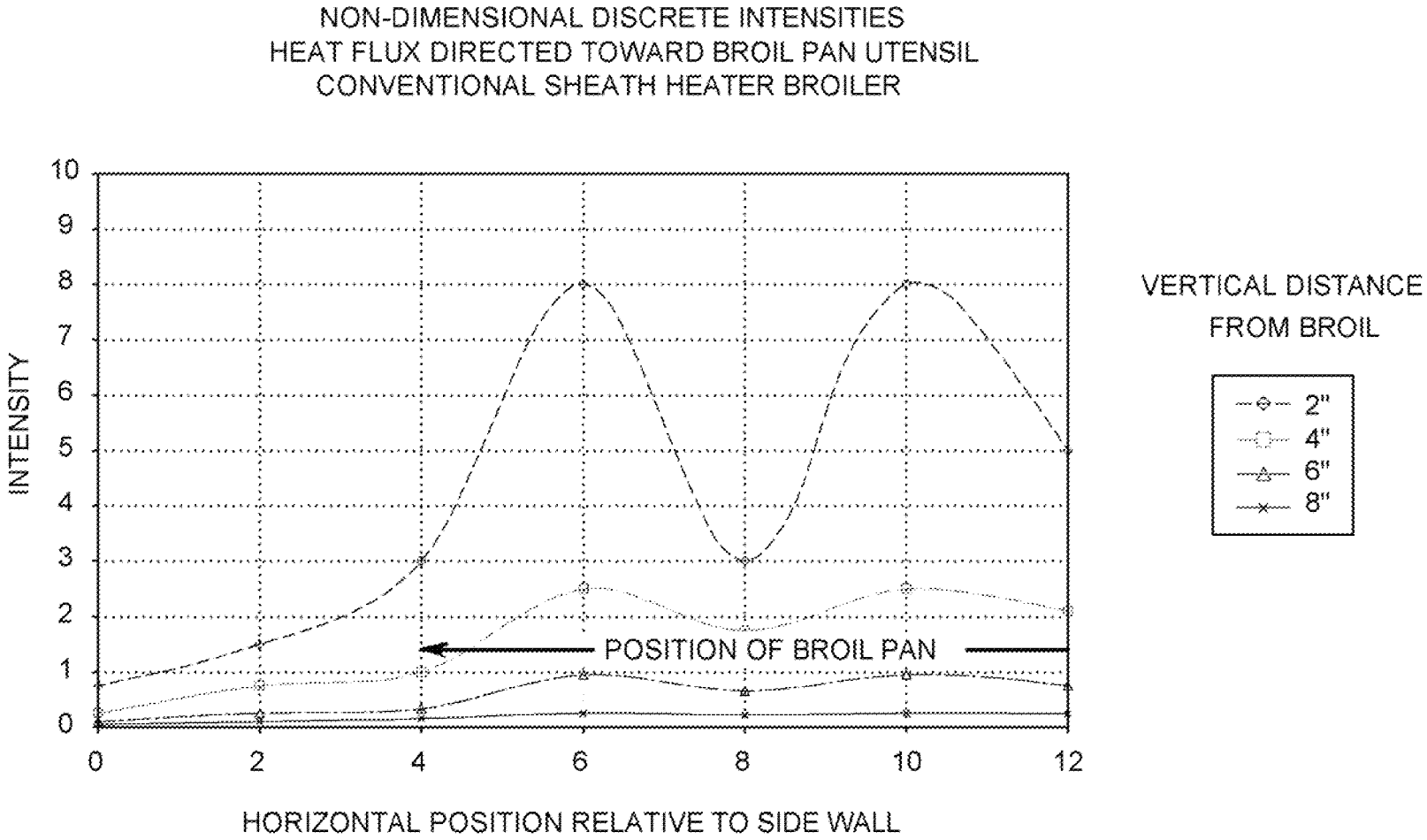
FIG. 5A is a heat flux pattern for a conventional sheath heater broiler.
Figure 5B:
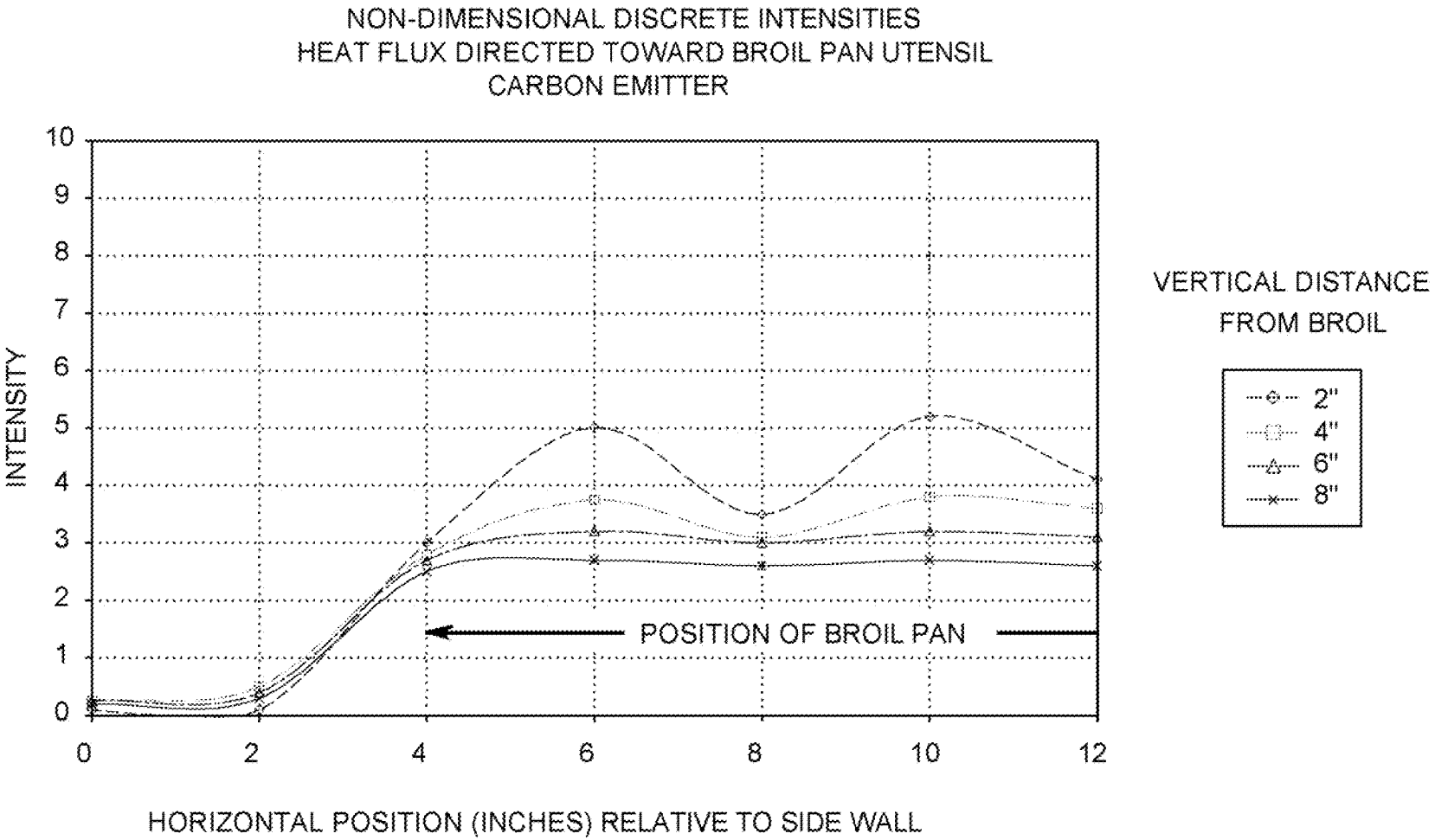
FIG. 5B is an exemplary heat flux pattern for a heating element of the disclosed embodiments.

Referring to FIGS. 5A and 5B, examples of heat flux patterns for both a conventional sheath heater broil element and a carbon emitter heating element of the disclosed embodiments are illustrated. The plot shown in FIG. 5A illustrates how the heat flux emitted by a conventional sheath heater broil element varies as a function of both vertical spacing from the food and lateral position within the oven cavity. Curve 502 represents a vertical distance of approximately 2 inches from the broil element. Curves 504, 506 and 508 represent vertical distances of approximately 4, 6 and 8 inches, respectively, from the broil element. As shown by curve 502, the gradients, such as points 510 and 512, become excessively large as the food is pushed closer to broil element, resulting in uneven browning and cooking. As the food is lowered away from the broil element, the gradients become less severe, but the flux intensity drops off significantly, resulting in longer cooking times.

In FIG. 5B, the heat flux intensity is again shown as a function of vertical spacing from the heating element and lateral spacing within oven cavity, where the heating element is the carbon emitter heating element, such as element 220A, of the disclosed embodiments. Here, curve 520 represents a vertical distance of approximately 2 inches from the heating element, while curves 522, 524 and 528 represent vertical distances of approximately 4, 6 and 8 inches, respectively, from the heating element As shown in FIG. 5B, the gradients, such as gradients 528 and 530, are much lower for this broiler. In particular, the flux intensity stays relatively constant, which means food can be ensured of cooking evenly and quickly regardless of its placement in the oven.

In one aspect of the exemplary embodiments, the controller 199 (FIG. 1A) may be configured to individually cycle (e.g. turn on and off) each of the one or more heating elements 220A-220D. Individually cycling the one or more heating elements 220A-220D may allow for a more even heat distribution (e.g. front to back and side to side with respect to a plane of a given oven cavity cooking position A-F) than if all of the one or more heating elements are continuously active. The cycling of the heating elements 220A-220D may also allow for the placement of food on oven racks at closer distances to the one or more heating elements 220A-220D.

The exemplary embodiments described herein provide a broiler assembly 160 (FIG. 1B) that directs substantially all of its energy towards food placed within the oven cavity 125 (FIGS. 1A and 1B) adjacent the broiler assembly 160. This provides for increased efficiency (e.g. energy into the food versus energy supplied in the oven cavity) by about 25% compared to conventional broilers, as well as a more even application of heat across the food tray and the food being cooked. The increased efficiency may translate into less energy needed to cook food, less preheat needed to reach a desired operating temperature, potentially faster cooking times and more even cooking.

Thus, while there have been shown and described and pointed out fundamental novel features of the invention as applied to the exemplary embodiments thereof, it will be understood that various omission and substitutions and changes in the form and details of devices illustrated, and in their operation, may be made by those skilled in the art without departing from the spirit of the invention. For example, it is expressly intended that all combinations of those elements and/or method steps, which perform substantially the same way to achieve the same results, are with the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A broiler assembly for a cooking appliance, the cooking appliance haying an oven cavity with the broiler assembly being disposed within the oven cavity, the broiler assembly comprising:

a reflector having first and second sides;

side retainers coupled to a respective one of the first and second sides;

a plurality of carbon emitter heating elements mounted to the side retainers the carbon emitter heating elements collectively developing a substantially constant heat flux intensity within the oven cavity; and a controller connected to the plurality of carbon emitter heating elements and operative to individually cycle the plurality of carbon emitter heating elements to produce the substantially constant heat flux intensity within the oven cavity.

2. The broiler assembly of claim 1, wherein each carbon emitter heating element comprises a substantially flat carbon filament.

3. The broiler assembly of claim 1, wherein each carbon emitter heating element comprises a quartz or fused silica transparent lamp having a carbon filament disposed in the lamp.

4. The broiler assembly of claim 3, wherein the side retainers comprise a first side retainer and a second side retainer, each of the first and second side retainers comprising at least one aperture configured to receive at least part of the plurality of carbon emitter heating elements.

5. The broiler assembly of claim 4, wherein the lamp comprises a first end, a second end and a first insulator disposed on the first end, the first and second ends extending laterally between the first and second side retainers, the first insulator being configured to engage the at least one aperture of the first side retainer such that the first insulator is substantially fixed laterally relative to the first side retainer.

6. The broiler assembly of claim 5, wherein the lamp further comprises a second insulator disposed on the second end, the second insulator being configured to engage the at least one aperture of the second side retainer such that the second insulator is free to move laterally relative to the second side retainer.

7. The broiler assembly of claim 1, wherein the cooking appliance comprises a rack disposed within the oven cavity, the rack configured to be located at variable positions within the oven cavity relative to a location of the broiler assembly, and wherein the heat flux intensity developed by the carbon emitter heating elements is substantially constant for each position of the rack within the oven cavity.

8. A cooking appliance comprising:

a frame forming an oven cavity; and a broiler assembly disposed within the oven cavity, the broiler assembly comprising:

a reflector having first and second sides;

side retainers coupled to a respective one of the first and second sides;

a plurality of carbon emitter heating elements mounted to the side retainers, the carbon emitter heating elements collectively developing a substantially constant heat flux intensity within the oven cavity; and a controller connected to the plurality of carbon emitter heating elements and operative to individually cycle the plurality of carbon emitter heating elements to produce the substantially constant heat flux intensity within the oven cavity.

9. The cooking appliance of claim 8, wherein each carbon emitter heating element comprises a substantially flat carbon filament disposed in a glass tube.

10. The cooking appliance of claim 9, wherein the glass tube comprises a quartz or fused silica transparent lamp.

11. The cooking appliance of claim 10, wherein the side retainers include a first and second side retainer, each of the first and second side retainers including at least one aperture configured to receive at least part of the plurality of carbon emitter heating elements.

12. The cooking appliance of claim 11, wherein the lamp comprises a first end, a second end and a first insulator disposed on the first end, the first and second ends extending laterally between the first and second side retainers, the first insulator being configured to engage the at least one aperture of the first side retainer such that the first insulator is substantially fixed laterally relative to the first side retainer.

13. The cooking appliance of claim 12, wherein the lamp further comprises a second insulator disposed on the second end, the second insulator being configured to engage the at least one aperture of the second side retainer such that the second insulator is free to move laterally relative to the second side retainer.

14. The cooking appliance of claim 8, wherein the cooking appliance comprises a rack disposed within the oven cavity, the rack configured to be located at variable positions within the oven cavity relative to a location of the broiler assembly, and wherein a heat flux intensity developed by the carbon emitter heating elements is substantially constant for each position of the rack within the oven cavity.

15. The cooking appliance of claim 14, wherein the heat flux intensity remains substantially constant at increasing vertical distances of the rack from the broiler assembly.

* * * * *